United States Patent [19]

Dzitzer

[11] Patent Number: 4,492,373

[45] Date of Patent: Jan. 8, 1985

[54] BODY THERAPEUTIC AND EXERCISING APPARATUS

[76] Inventor: Max Dzitzer, 1953 Rayshire St., Thousand Oaks, Calif. 91360

[21] Appl. No.: 437,964

[22] Filed: Nov. 1, 1982

Related U.S. Application Data

[63] Continuation-in-part of Ser. No. 223,686, Jan. 9, 1981, abandoned.

[51] Int. Cl.[3] ..... A61H 1/02

[52] U.S. Cl. ..... 272/61; 128/75; 272/85

[58] Field of Search ..... 272/61, 75, 85, 71, 272/109, 112, 62–64, 110–113, 93, 144; 128/75; D21/244, 245; 182/7

[56] References Cited

U.S. PATENT DOCUMENTS

| | | | |
|---|---|---|---|
| 1,340,904 | 5/1920 | Medart | 272/85 |
| 1,629,676 | 5/1927 | Buckminster | 272/61 |
| 1,646,158 | 12/1925 | McWhirter | 272/61 |
| 2,795,423 | 6/1957 | Fagergren | 272/85 |
| 3,191,932 | 6/1965 | Brilz | 272/85 |
| 3,521,848 | 7/1970 | Aase | 272/61 R |
| 3,593,708 | 7/1971 | Steele | 272/61 |
| 3,874,375 | 4/1975 | Penner | 272/61 |
| 3,966,202 | 6/1976 | Cynamon | 272/71 |
| 4,077,403 | 3/1978 | Steele | 128/75 |
| 4,289,310 | 9/1981 | Weakly | 272/85 |

FOREIGN PATENT DOCUMENTS

| | | | |
|---|---|---|---|
| 16533 | 2/1904 | Austria | 272/112 |
| 633458 | 10/1963 | Belgium | 272/112 |
| 858148 | 5/1940 | France | 272/61 |
| 130089 | 11/1950 | Sweden | 272/65 |
| 2040697 | 9/1980 | United Kingdom | 272/85 |

OTHER PUBLICATIONS

Child Life–"Quality Play Equipment, p. 22.

*Primary Examiner*—Richard J. Apley
*Assistant Examiner*—S. R. Crow
*Attorney, Agent, or Firm*—Jack C. Munro

[57] ABSTRACT

A therapeutic exercising device which takes the form of a pair of elongated hangers which are to suspend in a parallel manner from a fixed structure. Each hanger is pivotally connected in respect to the fixed structure. The free end of each hanger is pivotally connected to a sling. There is at least one bar connecting between the hangers and spaced from the sling. The bar is to be pivotally connected to the hangers. The sling is to closely conform to the midriff or hip area of the user and the user is to suspend from the sling in an up-side-down manner. The sling is to be readily detachable from the hangers. Preferably, the hangers are to comprise a pair of rigid members.

4 Claims, 8 Drawing Figures

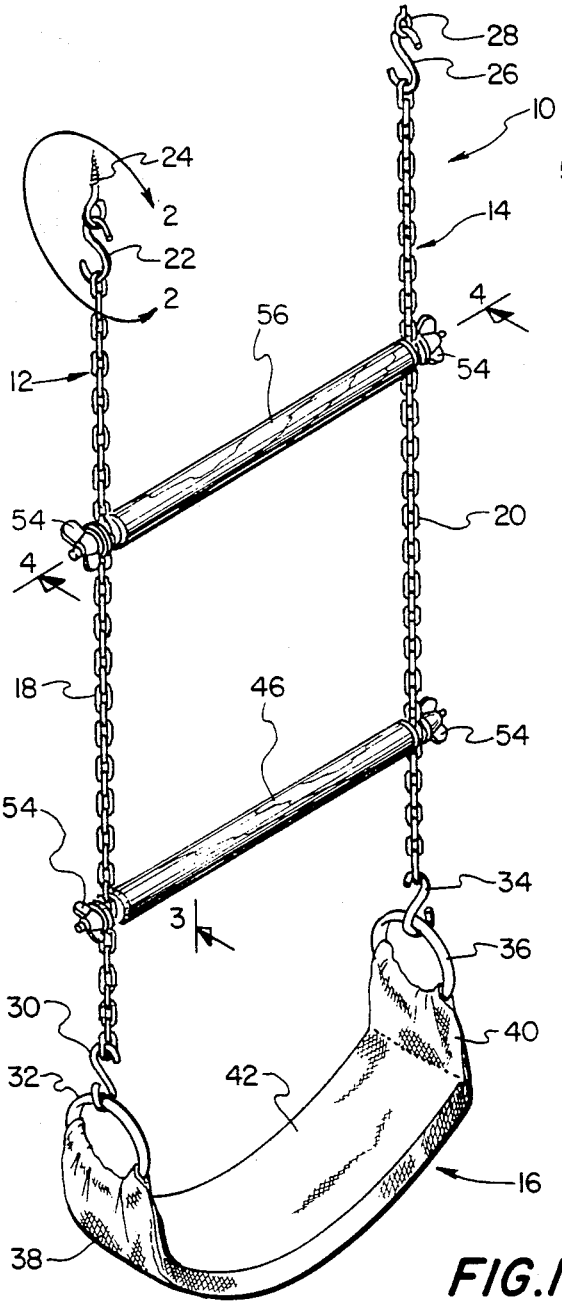
FIG. 1.
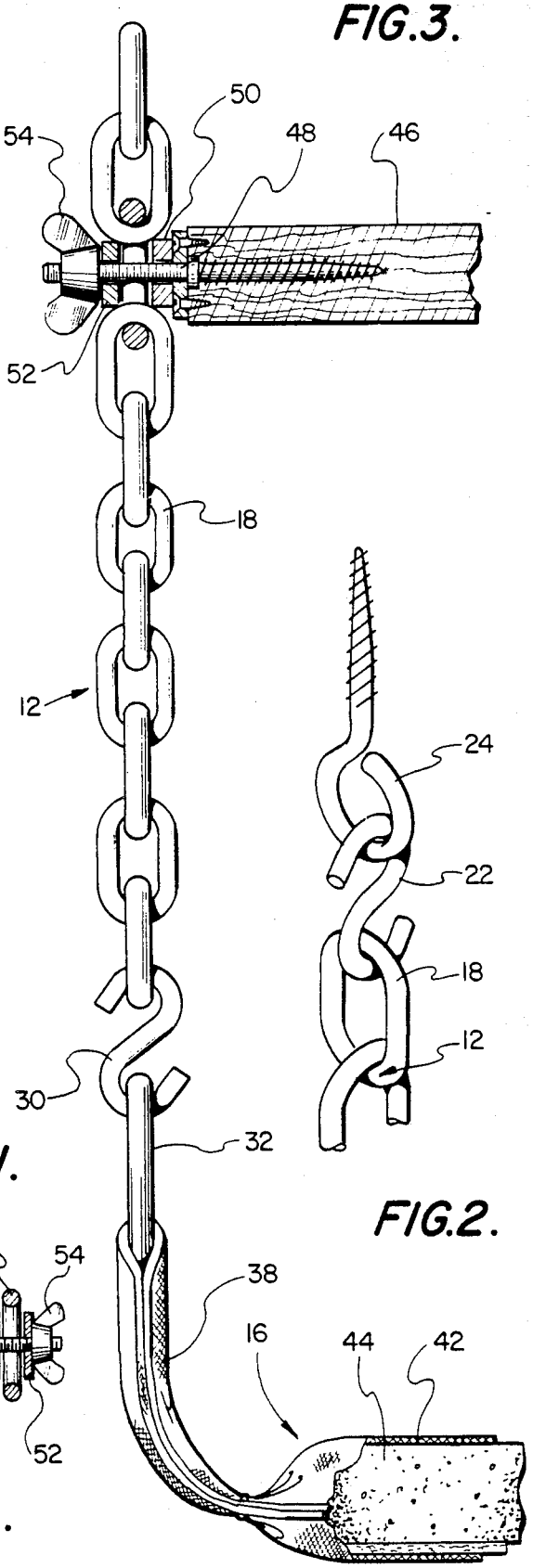
FIG. 3.
FIG. 2.
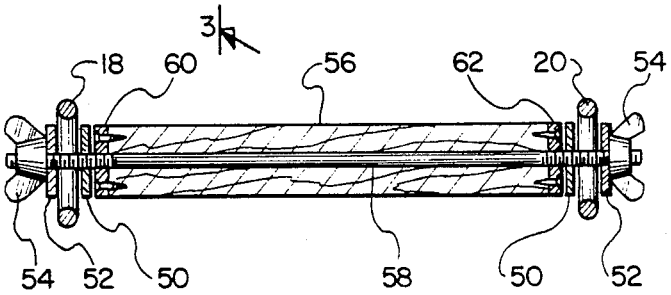
FIG. 4.

BODY THERAPEUTIC AND EXERCISING APPARATUS

REFERENCE TO PRIOR APPLICATION

This application is a continuation-in-part application of U.S. patent application Ser. No. 223,686, filed Jan. 9, 1981, now abandoned, by the same title and by the same inventor.

BACKGROUND OF THE INVENTION

The field of this invention relates to an exercising device for human beings and more particularly to an exercising device which also has therapeutic value.

An apparatus which is to be utilized by a human being in order to suspend the body of the human being in an up-side-down manner has been previously known. A great many people tend to have different types of back problems. Almost invariably these back problems are associated with a significant amount of constant pain. Certain individuals are able to alleviate this pain and improve their back by suspending themselves in an up-side-down manner. The normal procedure is for the individual to mount an apparatus and remain suspended for a period of time, such as fifteen minutes to a half hour. For some people, if this suspension is done frequently, such as twice a day, that even a persistent back problem can be alleviated.

The prior art type of body suspension devices have normally taken the form of a frame which is mounted off the floor. Within this frame is mounted a horizontal bar. Located on the horizontal bar are a pair of spaced-apart pads. The user is to place his body through the frame and locate the front portion of the upper part of a leg on a pad. The user then permits his body to be located in the up-side-down suspended position. It is believed that the pull of gravity working in the opposite direction has a tendency to straighten the user's back effecting a temporary cure of the back problem.

The primary difficulty with the prior art structures is that these pads are not comfortable and exert a high concentration of localized pressure on the user's legs. As a result, the user is not able to remain in this suspended position for a substantial period of time. Generally, with the prior art structure, fifteen minutes is as long as any individual could use such a device.

It would be desirable to construct a body suspension device in which the user can remain comfortably suspended for an extended period of time. Also, it would be desirable to construct the body suspension device to also further function as an exercising device.

SUMMARY OF THE INVENTION

The structure of this invention includes a pair of elongated members which are hung from an overhead support, such as a cross beam of a doorway or a ceiling beam. Each of the elongated members are to be hung from the fixed support by means of a hook, or similar device, so as to facilitate a pendulum type of motion of the elongated members with respect to the fixed structure. The elongated members can comprise a pair of flexible members such as chains or comprise rigid members such as a solid metallic strip. The free end of each of the elongated members is attached to a sling. Each end of the sling includes a ring. An end of an elongated member is pivotally attached to one of the rings with the free end of the other elongated member being attached to the other ring. A plurality of short horizontal bars are to be connected in between the elongated members in a spaced-apart manner. The position of these bars is to be adjustable with respect to the elongated members. Each of the bars is to be pivotable with respect to the elongated members. The sling is to be constructed of a padded fabric material so as to facilitate comfort for the user.

BRIEF DESCRIPTION OF THE DRAWINGS

FIG. 1 is an overall isometric view of the exercising device of this invention which is hung from the overhead support by chains;

FIG. 2 is an enlarged, segmental view showing the structure to facilitate the connecting of one of the elongated hangers to a fixed structure taken along line 2—2 of FIG. 1;

FIG. 3 is a front view of a portion of the exercising device of this invention taken along line 3—3 of FIG. 1;

FIG. 4 is a cross-sectional view through one of the horizontal bars employed with the exercising device of this invention taken along line 4—4 of FIG. 1;

DETAILED DESCRIPTION OF THE SHOWN EMBODIMENT

Figure 5:
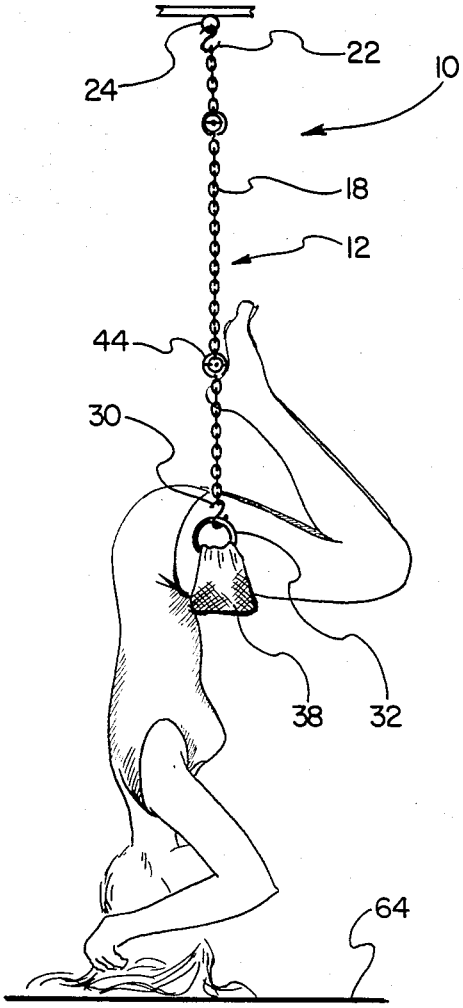
FIG. 5 is a diagramatic illustration showing the exercising device of this invention in use wherein the user is suspended in an up-side-down position.

Referring particularly to the drawings, there is shown the exercising and therapeutic device 10 of this invention which is composed primarily of first hanger 12, a second hanger 14 and a sling 16.

The first hanger 12 comprises an elongated member constructed of links 18 forming a chain. In a similar manner, the second hanger 14 comprises an elongated member constructed also of links 20 of a chain. At the upper end of the chain 12, the chain is connected to an S-shaped hook 22. This S-shaped hook 22 is in turn connected to an eye bolt 24. The eye bolt 24 is in turn to be secured into a fixed structure, such as a wooden beam (not shown).

In a similar manner, the upper end of the second hanger 14 is connected to an S-hook 26 which in turn is mounted on an eye bolt 28. The eye bolt 28 is then to be also secured to the fixed structure.

The lower end of the chain 12 connects with an S-hook 30. This S-hook 30 in turn connects with ring 32. In a similar manner, the lower end of the elongated member 14 connects with an S-hook 34, which in turn connects with a ring 36. It is to be noted that there is free pivoting movement between each of the rings 32 and 36 in respect to their respective hooks 30 and 34 and also freedom of free pivoting movement of the hooks 34 in respect to the respective elongated members 12 and 14.

Each of the rings 32 and 36 are secured to respective webbing 38 and 40. This webbing 38 and 40 may be secured as by sewing to the rings. The webbing 38 and 40 will normally comprise some type of fabric.

The webbing 38 and 40 is integrally connected to a sheet material, fabric cover 42. Within the cover 42 is located a quantity of padding 44. This padding 44 will normally comprise some type of foam rubber or other similar type of resilient material. It is to be noted that the sling 16 is flexibly constructed of the padding 44, the cover 42, the webbings 38 and 40 and the rings 32 and 36.

Referring particularly to FIGS. 1 and 3, there is shown a short, horizontally shaped bar 46. This bar 46 will normally be constructed of wood or other similar material. Secured in each end of the bar 46 is a threaded rod 48, only one of which is shown at one end of the bar 46 within FIG. 3. This threaded rod 48 is to be conducted through a first washer 50, through an opening within a link 18, through a second washer 52 and is to connect by fasteners to wing nut 54. It is to be noted that the identical type of connection is to be accomplished also with the hanger 14. The bar 46 is to be readily pivotable with respect to the hangers 12 and 14. It has been found that even upon tightening of the wing nuts 54, the bar 46 can still be pivoted relative to the hangers 12 and 14. This is due to the minimal contact area between the hangers 12 and 14 and their respective washers 50 and 52. The bar 46 can be located at any desired location along hangers 12 and 14. However, the bar 46 should be spaced for the particular size of the individual when located in an up-side-down suspended position (as is shown with FIG. 5) so that the user's feet will rest against the bar 46. This provides a certain amount of stability for the user.

It also may be desirable to include a second bar 56 for the purpose of facilitating the performing of certain types of exercises. The bar 56 is attached in precisely the same manner as bar 46 to the hangers 12 and 14 and like numerals have been employed to refer to like parts. However, the bar 56 is constructed somewhat differently in that the use of the two separate threaded members 48 has been eliminated and a single elongated rod 58 extends entirely through the bar 56. The rod 58 is fixed in position within the bar 56 and is held in that position by end caps 60 and 62 attached at the longitudinal ends of the bar 56.

Shown within FIG. 5 is the exercising device of this invention showing the user in an up-side-down suspended position for therapeutic value.

Figure 6:
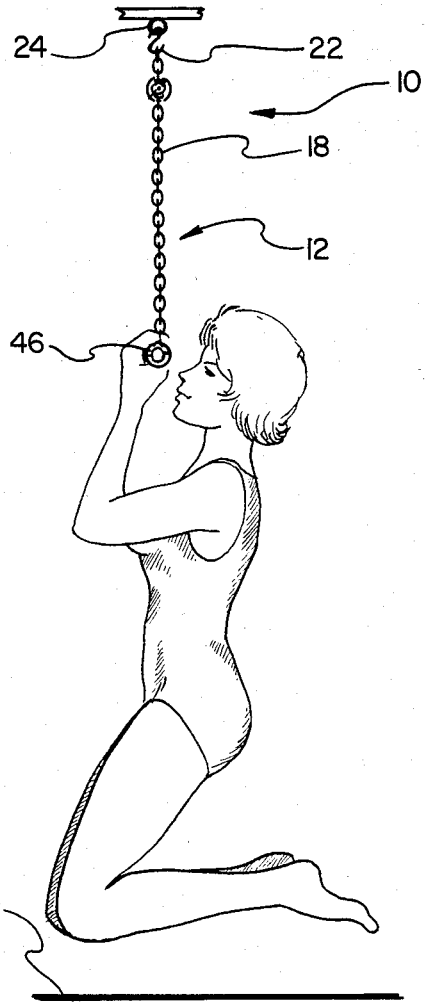
FIG. 6 is a diagramatic view showing use of the device of this invention to perform one type of exercise.

Referring particularly to FIG. 6, there is shown the exercising device 10 of this invention employed with the sling 16 having been removed and the bar 46 having been moved to connect with the lowermost links 18 and 20 of the elongated members 12 and 14. The user within FIG. 6 is shown doing an exercise which is frequently termed a "chin-up".

Figure 7:
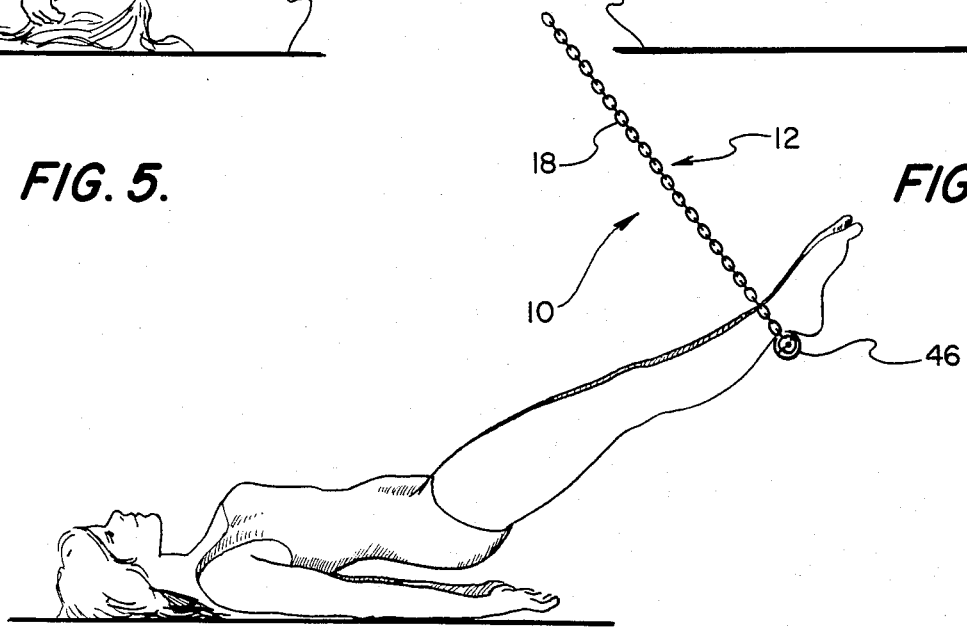
FIG. 7 is a diagramatic view showing the device of this invention being used to perform another type of exercise.

Referring particularly to FIG. 7, there is shown a user using the exercising device of this invention with the user being located on the floor. In this particular position, the entire length of the elongated members 12 and 14 will be utilized. In contrast with FIG. 6, the elongated members 12 and 14 have been adjusted considerably so as to space the bar 46 a substantial distance above the floor 64.

Figure 8:
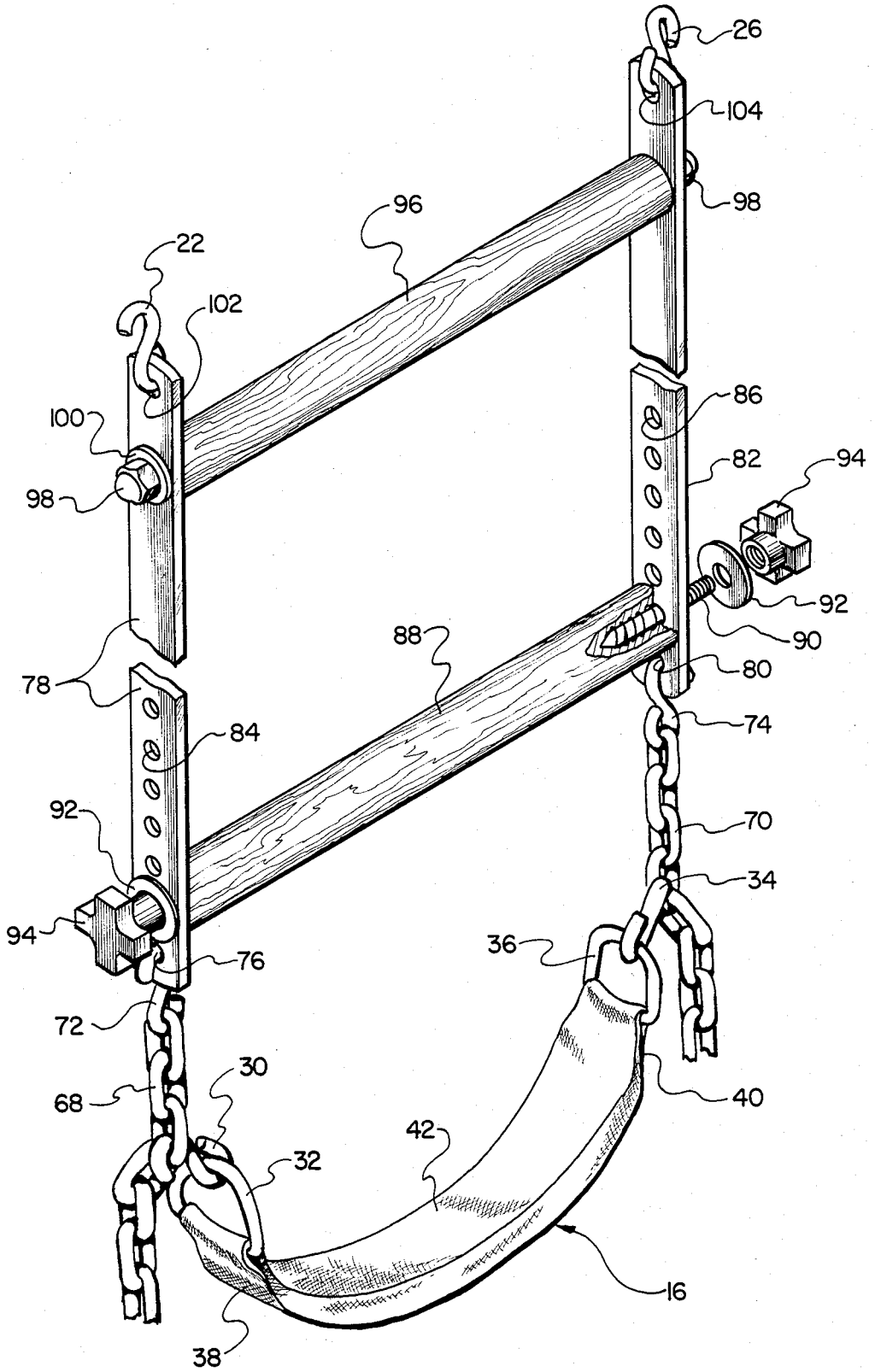
FIG. 8 is an isometric view of a modified version of exercising device of this invention wherein the device is hung from the overhead support by rigid walled members.

Referring particularly to FIG. 8, there is shown a modified version 66 of exercising device 10 of this invention. Similar numerals have been utilized to refer to similar parts. The hooks 30 and 34 are connected to chains 68 and 70, respectively. The chains 68 and 70 are respectively connected to S-shaped hooks 72 and 74. Hook 72 is connected within lowermost opening 76 of the rigid member 78. Similarly, the hook 74 engages with opening 80 of rigid member 82. The members 78 and 82 are basically identical in construction. Normally the members 78 and 82 will be constructed of a rigid material, such as metal stock.

The member 78 also includes a series of openings 84 which are in alignment with the opening 76. Similarly, a series of openings 86 are formed within the members 82 and are also in alignment with the opening 80. A horizontally shaped bar 88 is to be mounted between the members 78 and 82. Extending from each end of bar 88 is a threaded member 90 (only one being shown). One of the threaded members 90 is to extend through one of the openings 84, while the other of the threaded members 90 is to extend through an opening 86. Located about each threaded member is a washer 92, with a knob 94 being threadably secured to the outer end of each of the threaded members 90. One of the knobs 94 is to abut against the member 78, while the other knob 94 abuts up against the member 82.

Also mounted between the members 78 and 82 is a second bar 96. The second bar 96 is the same length as the bar 88. The second bar 96 includes threaded members (not shown) which protrude from each end thereof. One of the threaded members is to pass through an opening (not shown) formed within the member 78, while the other threaded member passes through an opening (not shown) through the member 82. A nut 98 and washer 100 is located about each threaded member and tightly secures the bar 96 to both of the members 78 and 82. The upper end of the member 78 includes an opening 102 which connects with the S-hook 22. Similarly, the upper end of the member 82 includes an opening 104 which engages with the S-hook 26.

It is to be understood that the bars 88 and 96 in conjunction with the members 78 and 82 form a rigid frame. The main advantage of this modified structure over that shown in FIG. 1 is that the structure is not capable of lateral movement. Swinging movement is only possible. This means that if the exercising device is mounted within a doorway, (not shown) the device will not be capable of moving laterally to scar up the vertical sidewalls of the door jam.

It is to be understood that the bar 88 is to be adjustable in the same manner as the bar 46 is adjustable. This adjustability is limited by the number of the openings 84 and 86. The sling 16 is to be adjustable to engage different lengths of the chains 68 and 70.

What is claimed is:

1. A therapeutic exercising device comprising:

a first hanger and a second hanger, both said first hanger and said second hanger having an upper end and a lower end, each said upper end including a hanging means, said hanging means facilitating connection of both said first and second hangers to fixed structures so said first and second hangers suspend therefrom, said first hanger including a first rigid member, said second hanger including a second rigid member;

a first chain connected to and extending from said first rigid member of said first hanger at said lower end, a second chain connected to and extending from said second rigid member of said second hanger at said lower end;

a sling having a fore end and an aft end, said fore end terminating in a first pivot connection, said aft end terminating in a second pivot connection, said first pivot connection being connected to said first chain with said second pivot connection being connected to said second chain, said sling being flexibly resilient, said sling being constructed of a soft padding encased within a sheet material fabric cover, whereby said sling is to readily conform to the users body in the midriff area during suspension of the user in an up-side-down manner;

both said first pivot connection and said second pivot connection comprises:

a first ring and a second ring, both said first and second rings being connected by sewing to said sheet material fabric cover, a first hook removably connected to said first chain, said first hook being connected to said first ring, a second hook removably connected to said second chain, said second hook being connected to said second ring, said first and second hooks can be disengaged from their respective said chain and relocated to a different location on its respective said chain thereby providing adjustment;

both said first rigid member and said second rigid member including a series of openings; and at least one rigid bar member connecting said first rigid member and said second rigid member, said rigid bar member being spaced from said sling, said bar member being removably connected to said series of openings of first and second rigid members by a manually operable knob assembly.

2. The exercising device as defined in claim 1 wherein:

there being a plurality of said rigid bar members being located in a spaced apart manner connected between said first rigid member and said second rigid member.

3. The exercising device as defined in claim 2 wherein:

each of said rigid bar members being freely pivotable in respect to said first rigid member and said second rigid member.

4. The exercising device as defined in claim 3 wherein:

each said upper end being pivotally connected to said fixed structure.

* * * * *